US007236570B2

(12) United States Patent
Canfield

(10) Patent No.: US 7,236,570 B2
(45) Date of Patent: Jun. 26, 2007

(54) SEMI-PERMEABLE DIAPHRAGM SEALING SYSTEM

(75) Inventor: Bradley Dee Canfield, Orem, UT (US)

(73) Assignee: Varian Medical Systems Technologies, Inc., Palo Alto, CA (US)

( * ) Notice: Subject to any disclaimer, the term of this patent is extended or adjusted under 35 U.S.C. 154(b) by 52 days.

(21) Appl. No.: 10/953,232

(22) Filed: Sep. 29, 2004

(65) Prior Publication Data

US 2006/0067478 A1 Mar. 30, 2006

(51) Int. Cl.
*H01J 35/10* (2006.01)

(52) U.S. Cl. ..... 378/141; 378/200

(58) Field of Classification Search ..... 55/385.4; 95/6; 96/6; 220/560.03; 378/130, 141, 378/200, 202

See application file for complete search history.

(56) References Cited

U.S. PATENT DOCUMENTS

| | | | | |
|---|---|---|---|---|
| 2,081,077 | A * | 5/1937 | Wantz | 378/202 |
| 2,454,525 | A * | 11/1948 | Rogers et al. | 378/194 |
| 2,611,095 | A * | 9/1952 | Goldfield et al. | 378/202 |
| 5,522,769 | A * | 6/1996 | DeGuiseppi | 454/270 |
| 6,074,092 | A * | 6/2000 | Andrews | 378/200 |
| 6,366,642 | B1 * | 4/2002 | Andrews | 378/130 |
| 6,764,216 | B2 * | 7/2004 | Penato et al. | 378/200 |
| 2005/0147208 | A1 * | 7/2005 | Kendall et al. | 378/141 |

OTHER PUBLICATIONS

Web page: "GORE™ Membrane Vents, Screw-In Vent: POV/M12×1,5," www.Gore.com/ventsolutions, W.L. Gore & Associates, 2002.

Web page: "GORE™ Membrane Vents, Screw-In Vent: POV/M12×1," www.Gore.com/ventsoloutions, W.L. Gore & Associates, 2002.

Web page: "GORE™ Membrane Vents," www.Gore.com/prevent, W.L. Gore & Associates.

Web page: "GORE™ Membrane Vents," www.Gore.com/en_xx/products/venting/technical/molded_parts, W.L. Gore & Associates, 2006.

* cited by examiner

*Primary Examiner*—Edward J. Glick
*Assistant Examiner*—Jurie Yun
(74) *Attorney, Agent, or Firm*—Workman Nydegger

(57) ABSTRACT

A sealing system is disclosed for preventing liquid escape from the reservoir of an apparatus, such as an x-ray tube, that utilizes a diaphragm for maintaining constant liquid pressure in the reservoir. The sealing system of embodiments of the present invention contains liquid that leaks from the reservoir as a result of rupture or other failure of the diaphragm. In one embodiment, a diaphragm cooperates with an outer housing of an x-ray tube to define a reservoir for containing a cooling liquid. The diaphragm sealing system surrounds the diaphragm and includes a semi-permeable membrane that enables air to pass through to the diaphragm to expose it to atmospheric pressure for proper operation thereof. Upon diaphragm failure, the membrane has hydrophobic and oleophobic properties to prevent cooling liquid from escaping the diaphragm sealing system, and hence, the x-ray tube, thereby preventing the cooling liquid from presenting a health or safety hazard.

28 Claims, 6 Drawing Sheets

SEMI-PERMEABLE DIAPHRAGM SEALING SYSTEM

BACKGROUND

1. Technology Field

The present invention generally relates to x-ray generating devices. In particular, the present invention relates to a system that prevents leakage of liquid from an apparatus, such as an x-ray tube, that utilizes a diaphragm.

2. The Related Technology

X-ray producing devices, such as x-ray tubes, are extremely valuable tools that are used in a wide variety of applications, both industrial and medical. For example, such equipment is commonly employed in areas such as medical diagnostic examination and therapeutic radiology, semiconductor manufacture and fabrication, and materials analysis.

Regardless of the applications in which they are employed, x-ray tubes operate in similar fashion. In general, x-rays are produced when electrons are emitted, accelerated, then impinged upon a material of a particular composition. This process typically takes place within an evacuated enclosure of the x-ray tube. Disposed within the evacuated enclosure is a cathode, or electron source, and an anode oriented to receive electrons emitted by the cathode. The anode can be stationary within the tube, or can be in the form of a rotating annular disk that is mounted to a rotor shaft which, in turn, is rotatably supported by a bearing assembly. The evacuated enclosure is typically contained within an outer housing, which also serves as a reservoir for a cooling liquid, such as dielectric oil, that serves both to cool the x-ray tube and to provide electrical isolation between the tube and the outer housing.

In operation, an electric current is supplied to a filament portion of the cathode, which causes a cloud of electrons to be emitted via a process known as thermionic emission. A high voltage potential is placed between the cathode and anode to cause the cloud of electrons to form a stream and accelerate toward a focal spot disposed on a target surface of the anode. Upon striking the target surface, some of the kinetic energy of the electrons is released in the form of electromagnetic radiation of very high frequency, i.e., x-rays. The specific frequency of the x-rays produced depends in large part on the type of material used to form the anode target surface. Target surface materials with high atomic numbers ("Z numbers") are typically employed. The target surface of the anode is oriented so that the x-rays are emitted as a beam through windows defined in the evacuated enclosure and the outer housing. The emitted x-ray beam is then directed toward an x-ray subject, such as a medical patient, so as to produce an x-ray image.

Generally, only a small portion of the energy carried by the electrons striking the target surface of the anode is converted to x-rays. The majority of the energy is rather released as heat. It is critical to remove excess heat produced during x-ray production to prevent failure of the x-ray tube. One common method in dissipating heat involves submerging the evacuated enclosure in a dielectric cooling liquid which, as explained above, is contained within a reservoir defined by the outer housing. The cooling liquid assists in absorbing heat from the evacuated enclosure that is produced therein during x-ray production and dissipating it to the surrounding environment. Such dissipation can be accomplished, for example, via conductive heat transfer between the cooling liquid and the surface of the outer housing. In this way, the operating temperature of the x-ray tube is maintained within acceptable levels.

In many liquid-filled x-ray tubes, one or more diaphragms are employed in order to maintain a relatively consistent liquid pressure within the reservoir at or near atmospheric pressure ("1 atm"). These diaphragms are flexible and many include an interior surface in liquid communication with a portion of the cooling liquid, and an exterior surface, which is in communication with the tube exterior such that it is subject to atmospheric pressure. During tube operation, heat created as a result of x-ray production is absorbed by the cooling liquid. Absorption of this heat causes the volume of the cooling liquid to expand. In response to this volume expansion, the diaphragm contracts, thereby expanding the relative size of the reservoir, which reduces the pressure of the cooling liquid.

Similarly, when cooling of the liquid occurs, its volume and corresponding pressure decrease. Expansion of the diaphragm is then triggered, which reduces the liquid reservoir volume, thereby increasing cooling liquid pressure. The diaphragm is configured and operated in this manner to maintain the cooling liquid pressure at or near 1 atm during tube operation, notwithstanding the cyclical temperature changes of the cooling liquid. This in turn enables the fluid-tight seals of the x-ray tube outer housing to be configured for mere liquid containment, and not for liquid containment at elevated pressures relative to atmospheric pressure. This consequently reduces both the complexity and cost of x-ray tube seals, thereby offering added savings for tube manufacturing.

Despite their utility in maintaining constant cooling liquid pressure, several challenges nevertheless exist with respect to diaphragm use. Many of these challenges relate to the unintended rupture or other failure of the diaphragm. When such failure occurs, escape of cooling liquid past the diaphragm can result. Further, because many tube designs require that the diaphragm be exposed to atmospheric pressure and therefore lack a fluid-tight seal about the diaphragm, cooling liquid that escapes past the diaphragm can also spill from the x-ray tube entirely. Such spillage is highly undesirable. As can be imagined, liquid escape from the x-ray tube not only presents a contamination problem, but can create a hazardous situation, presenting a health risk to tube users, patients, or others in close proximity to the x-ray tube. In particular, x-ray tubes are often employed in connection with medical x-ray scanning devices, such as CT scanners. An x-ray tube utilized in CT scanners are often mounted on a rotating gantry that achieves high rotational rates during scanning operations. Should the diaphragm of a CT scanner x-ray tube so positioned fail during use, extensive cooling liquid leakage and dispersal from the tube can result, including exposure to the local environment, users, patients, etc. As described above, cooling liquid often possesses significant quantities of absorbed heat, as described above, which can present a burn risk to those exposed to the liquid. Furthermore, some cooling liquids are hazardous substances and create an undesired contamination risk. For these and other reasons, diaphragm failure and its attendant consequences are to be avoided.

In an effort to reduce the. effects of diaphragm failure, some known x-ray tubes hermetically seal the diaphragm off within the outer housing and isolate it from atmospheric pressure influences. Though this alleviates liquid containment problems should the diaphragm fail, it nevertheless represents a significant additional expense in manufacturing such tubes, as all fluid-tight seals used in the outer housing must be designed to withstand the elevated pressure that result from such a tube design.

Another attempt at avoiding the above challenges has involved tubes that employ a dual diaphragm system, wherein a first diaphragm is backed by a backup second diaphragm in the outer housing of the x-ray tube. Though this dual diaphragm design can in certain cases enhance the safety of the x-ray tube in the event of a single diaphragm failure, both diaphragms must still be subject to atmospheric pressure, and therefore are still susceptible to the above undesirable consequences should failure of both diaphragms occur. Further, a dual diaphragm system is necessarily more complex than a single diaphragm system, thereby equaling greater production costs and more complication when tube servicing is required, as well as creating more possible failure points, given the extreme operating conditions in which x-ray tubes are often utilized.

In light of the above, a need exists for an x-ray tube having a diaphragm system that avoids the above problems. In particular, an x-ray tube having a sealing system that protects from cooling liquid escape in the event of diaphragm failure is needed. Such a solution should be easily adaptable to the variety of x-ray tube types and other apparatus without substantially increasing the complexity thereof. Any solution should also be adaptable to multiple diaphragm configurations found in these apparatus. In addition, any solution should not interfere with the operation of the diaphragm in maintaining a constant cooling liquid pressure within the x-ray tube.

BRIEF SUMMARY

The present invention has been developed in response to the above and other needs in the art. Briefly summarized, embodiments of the present invention are directed to a semi-permeable diaphragm sealing system for preventing unintended escape of cooling liquid from an x-ray tube or other similar apparatus. In particular, the diaphragm sealing system of the present invention is designed so as to enable atmospheric pressure to be exposed to a diaphragm located in an x-ray tube, thereby enabling proper function of the diaphragm during tube operation. Further, the sealing system is configured and is positioned with respect to the diaphragm so as to prevent any escape of cooling liquid from the x-ray tube should failure of the diaphragm occur through rupture, seal failure, etc. As a result, the cooling liquid is contained by the diaphragm sealing system, thereby preventing problems associated with cooling liquid escape from the x-ray tube, such as hazardous contamination about the x-ray tube environment, exposure to tube users and patients, etc.

In one embodiment, the diaphragm sealing system is included as a component in an x-ray tube having an evacuated enclosure that contains an electron-producing cathode and an anode positioned to receive electrons produced by the cathode. The evacuated enclosure is contained within an outer housing, which also defines a reservoir for containing a cooling liquid that envelopes the evacuated enclosure and absorbs heat therefrom during x-ray production. A diaphragm is also included in the outer housing and cooperates with the outer housing to define the cooling liquid reservoir. In response to changes in cooling liquid pressure as a result of heat absorption from the evacuated enclosure, the diaphragm can expand or contract to maintain the cooling liquid at or near atmospheric pressure.

In one embodiment, the diaphragm sealing system is positioned adjacent the diaphragm and includes a clamping ring that cooperates with an end of the outer housing to form a fluid-tight bond with a sealing edge formed about the perimeter of the diaphragm. A diaphragm cover is mated with the clamping ring to substantially cover an end of the outer housing as well as the diaphragm.

The diaphragm sealing system further includes a semi-permeable membrane interposed between an exterior portion of the x-ray tube and an outer surface of the diaphragm. The semi-permeable membrane is positioned so as to enable the diaphragm to be exposed to atmospheric pressure in order to allow proper operation thereof. In one embodiment, the semi-permeable membrane is composed of GORE™ membrane material manufactured by W.L. Gore & Associates, Inc. Further, in one embodiment, the GORE™ membrane is included within a membrane seal plug that is inserted into a hole defined in the diaphragm cover. So positioned, the membrane seal plug is configured to enable air and other vapors to pass through the semi-permeable membrane, thereby exposing the diaphragm to atmospheric air pressure.

Importantly, however, the, membrane seal plug is further configured to prevent the release of cooling liquid from the x-ray tube in the event of diaphragm failure. Should the diaphragm fail so as to allow cooling liquid to escape past the diaphragm, the cooling liquid then encounters the membrane seal plug of the diaphragm cover. Because of its characteristics, the semi-permeable membrane included in the membrane seal plug is both hydrophobic and olephobic, i.e., it repels liquids such as water and oil-based cooling liquids. Thus, the cooling liquid is stopped by the membrane seal plug and is prevented from escaping the tube outer housing via the plug or via the clamping ring and diaphragm cover, which are sealed to the outer housing. Thus, the semi-permeable membrane of the membrane seal plug enables proper operation of the diaphragm by providing atmospheric pressure thereto, while preventing the escape of cooling liquid by presenting a barrier past which the cooling liquid cannot proceed.

In other embodiments, the semi-permeable membrane and associated membrane seal plug can be positioned with respect to diaphragms in other configurations. In one embodiment, for instance, the semi-permeable diaphragm sealing system includes a membrane seal plug located in a hole defined in the diaphragm cover, but no sealing ring is included. Rather, the diaphragm cover itself mates with the outer housing of the x-ray tube, thereby sealing the edge of the diaphragm therebetween. In yet another embodiment, an o-ring is included with the diaphragm cover to further prevent leakage past the cover should the diaphragm fail.

In yet other embodiments, the membrane seal plug can be included with diaphragms that are located separate from the x-ray tube itself. For instance, the diaphragm can be located in a separate housing along a fluid line that supplies cooling liquid to the x-ray tube, or can be included in an expansion chamber or within a heat exchanger designed to remove heat from the cooling liquid. In any of these cases, the semi-permeable membrane-equipped plug described above can be positioned with respect to the diaphragm so as to enable it to be subject to atmospheric pressure while at the same time preventing cooling liquid leakage should failure of the diaphragm occur. In addition, the diaphragm sealing system disclosed in the embodiment described herein can be employed in diaphragm/liquid systems that do not include x-ray tubes.

In general, then, one embodiment of the present invention discloses a diaphragm sealing system for sealing a diaphragm defining at least a portion of a reservoir containing a liquid, wherein the system comprises a passageway defined between the diaphragm and a region of atmospheric pressure, and means for exposing the diaphragm to atmospheric pressure via the passageway, wherein said means further prevents the passage of the liquid via the passageway.

These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF SELECTED EMBODIMENTS

Reference will now be made to figures wherein like structures will be provided with like reference designations. It is understood that the drawings are diagrammatic and schematic representations of exemplary embodiments of the invention, and are not limiting of the present invention nor are they necessarily drawn to scale.

FIGS. 1–7 depict various embodiments of the present invention, which is generally directed to a semi-permeable diaphragm sealing system that prevents the leakage of cooling liquid from an apparatus, such as an x-ray tube. The diaphragm sealing system of embodiments of the present invention is configured to enable atmospheric pressure influence upon the diaphragm in order to preserve its functionality in maintaining a constant pressure of a liquid, such as a cooling liquid, disposed within a reservoir, such as a reservoir defined by the outer housing of an x-ray tube. Advantageously, embodiments of the present diaphragm sealing system are further configured to prevent the leakage of cooling liquid from the outer housing of an x-ray tube should rupture or other failure of the diaphragm occur. This prevents the contamination of the environment around the x-ray tube by cooling liquid that would otherwise spill from the tube. Further, use of the diaphragm sealing system to be described herein protects users, patients, and other persons in close proximity to an x-ray tube from cooling liquid exposure, thereby preventing hazardous contamination, burns, etc., that can result from such exposure. Embodiments of the invention accomplish the above via a semi-permeable membrane that reliably enables air and vapor to pass therethrough, while preventing the passage of cooling liquids, as will be described in detail. In addition, the diaphragm sealing system is simply constructed, including a minimum of parts, thereby maintaining the relative simplicity of the x-ray tube or other apparatus.

As used herein, the term "liquid" is understood to encompass flowable substances that tend not to disperse, and that are relatively incompressible. As used with regard to x-ray tubes herein, "liquid" is also understood to encompass any one of a variety of substances that can be employed in cooling and/or electrically isolating an x-ray or similar device. Examples of such a liquid include, but are not limited to, de-ionized water, insulating liquids, and dielectric oils. Further, while embodiments of the present invention described herein are concerned with integration of a diaphragm sealing system into a diaphragm-equipped x-ray tube, it is appreciated that the diaphragm sealing system as explained herein can be employed with diaphragms that compose part of other types of apparatus as well. Thus the discussion to follow is merely exemplary of the manner in which the present invention can be practiced.

Figure 1:
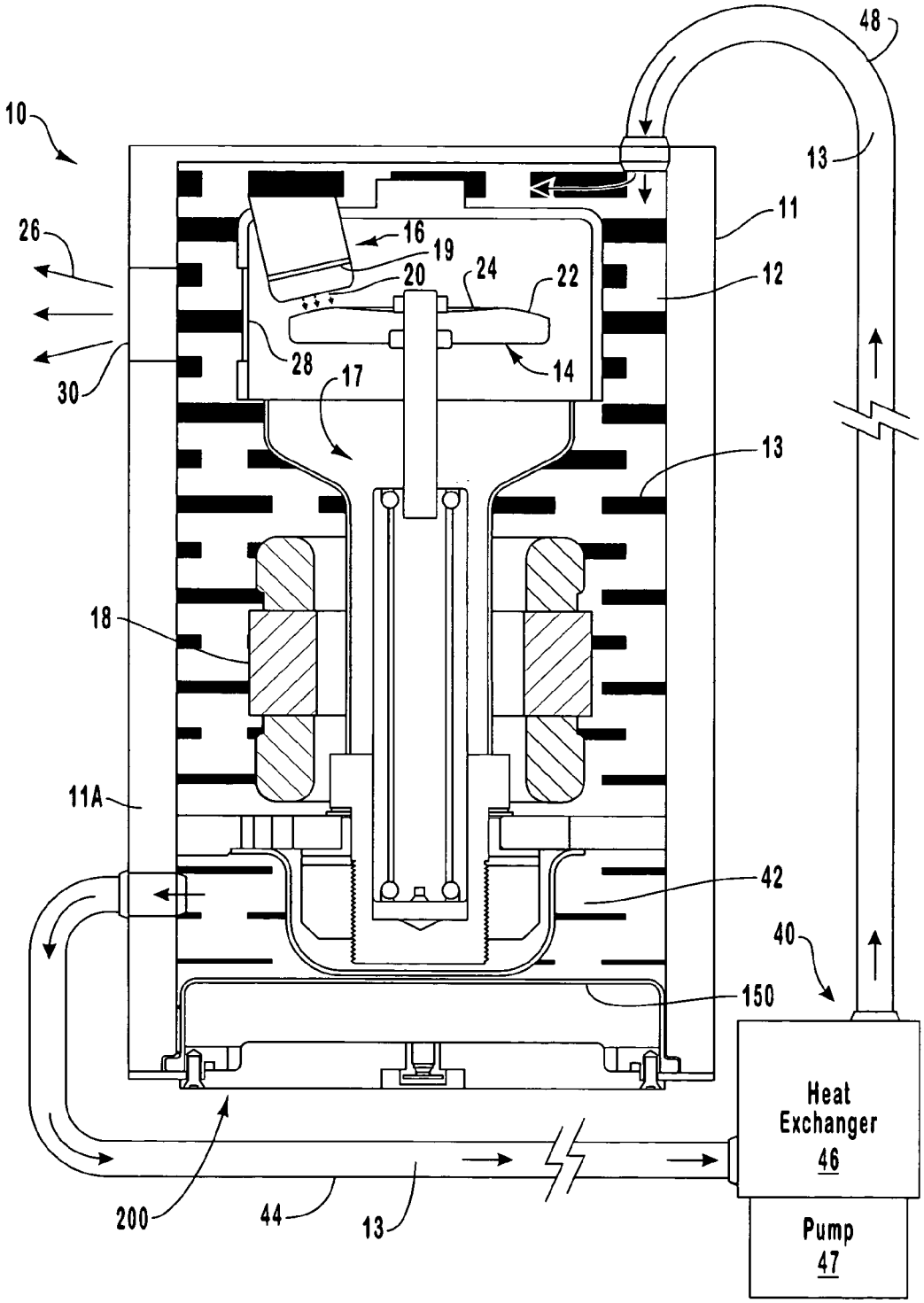
FIG. 1 is a simplified cross sectional depiction of an x-ray device incorporating a semi-permeable diaphragm sealing system according to one embodiment of the present invention.

Reference is first made to FIG. 1, which illustrates a simplified structure of a conventional rotating anode-type x-ray tube, designated generally at 10. X-ray tube 10 includes an outer housing 11, within which is positioned an evacuated enclosure 12. A cooling liquid 13 is also disposed within the outer housing 11 and envelops the evacuated enclosure 12 to assist in tube cooling and to provide electrical isolation between the evacuated enclosure and the outer housing. In one embodiment, the cooling liquid 13 is a dielectric oil, which provides desirable thermal and electrical insulating properties.

Positioned within the evacuated enclosure 12 are a rotating anode 14 and a cathode 16. The anode 14 is spaced apart from and oppositely disposed to the cathode 16, and is at least partially composed of a thermally conductive material such as copper or a molybdenum alloy. Specifically, the anode 14 is rotatably supported by a rotor assembly 17. The rotor assembly 17 provides rotation of the anode 14 during tube operation via a rotational force provided by a stator 18.

The cathode 16 includes a filament 19 that is connected to an appropriate power source such that during tube operation, an electrical current is passed through the filament to cause electrons, designated at 20, to be emitted from the cathode by thermionic emission. Application of a high voltage differential between the anode 14 and the cathode 16 causes the electrons 20 emitted from the filament 19 to accelerate from the cathode toward a focal track 22 that is positioned on a target surface 24 of the rotating anode 14. The focal track 22 is typically composed of tungsten or a similar material having a high atomic ("high Z") number. As the electrons 20 accelerate, they gain a substantial amount of kinetic energy, and upon striking the target material on the focal track 22, some of this kinetic energy is converted into electromagnetic waves of very high frequency, i.e., x-rays 26, shown in FIG. 1.

A significant portion of the x-rays 26 produced at the anode target surface is oriented such that the x-rays pass through both a first window 28 positioned in the evacuated enclosure 12 and a second window 30 positioned in the outer housing 11. The x-rays 26 can then be used for a variety of purposes,, according to the intended application. For instance, if the x-ray tube 10 is located within a medical x-ray imaging device, such as a CT scanner, the x-rays 26 emitted from the x-ray tube are directed for penetration into an object, such as a patient's body during a medical evaluation for purposes of producing a radiographic image of a portion of the body.

The x-ray tube 10 includes a cooling system generally designated at 40 that is utilized to ensure proper cooling of the evacuated enclosure 12 during tube operation. The cooling system 40, which is exemplary of many such cooling systems, includes a reservoir 42 defined by a wall 11A of the outer housing 11.

During tube operation, heat that is produced by the production of the x-rays 26 is created largely in the anode 14 and is radiated by the anode to the exterior portions of the evacuated enclosure 12. This heat is then absorbed by the cooling liquid 13 that circulates about the exterior of the evacuated enclosure 12. Following absorption, the cooling liquid 13 is then removed from the reservoir 42 by action of the pump 47, which is in liquid communication with the reservoir 42 and the cooling liquid 13 therein. The pump 47 moves the cooling liquid 13 from the reservoir 42 to a heat exchanger 46 via a first fluid line 44.

The heat exchanger 46, which is representative of one of a variety of apparatus, is used to remove thermal energy acquired by the cooling liquid 13 as a result of circulating about the evacuated enclosure 12 within the outer housing 11. The heat exchanger 46, therefore, removes excess heat from the cooling liquid 13 that is forwarded by the pump 47. Following this heat removal, the cooling liquid 13 is returned to the reservoir 42 of the outer housing 11 via a second fluid line 48 for subsequent heat removal. In this way, proper operating temperature of the x-ray tube 10 can be maintained.

It is appreciated that, though. the cooling system 40 depicted in FIG. 1 is one example of a cooling system for use in an x-ray tube, cooling systems that vary from that depicted herein, or that include additional or alternative components, can also be employed in connection with the present invention as disclosed herein.

As shown in FIG. 1, the x-ray tube 10 further includes a diaphragm 150 that is attached to a portion of the outer housing 11 at one end thereof. As positioned in FIG. 1, the diaphragm 150 defines a portion of the reservoir 42, thereby assisting in containing the cooling liquid 13 within the outer housing 11. The diaphragm 150 is included in the x-ray tube 10 in order to preserve the cooling liquid 13 at or near atmospheric pressure (i.e., "1 atm") within the reservoir 42 during tube operation. As is known, the cooling liquid 13 absorbs heat from the evacuated enclosure 12 and dissipates that heat via the cooling system 40. During this cooling cycle, however, the temperature of the cooling liquid can rise or fall according to the current level of heat absorption by the liquid. As the cooling liquid 13 increases in temperature, the volume of the cooling liquid correspondingly increases, thereby causing the diaphragm 150 to expand outward with respect to the reservoir 42 in order to expand the relative size of the reservoir. Expansion of the reservoir 42 causes the pressure of the heated cooling liquid 13 to decrease, thereby maintaining the cooling liquid pressure relatively constant. Similarly, when cooling of the cooling liquid 13 occurs, contraction in the volume and pressure of the cooling liquid causes a consequent inward contraction of the diaphragm 150 in order to reduce the volume of the reservoir 42 and maintain the pressure of the cooling liquid at or near 1 atm. As has been mentioned, use of a diaphragm within the x-ray tube 10 in this manner simplifies tube construction by negating the need for pressure seals in the outer housing 11, which correspondingly saves manufacturing costs.

As shown in FIG. 1, the x-ray tube 10 according to the illustrated embodiment further includes a diaphragm sealing system, generally designated at 200. As will be explained, the diaphragm sealing system 200 is configured to enable proper diaphragm operation by enabling the exposure of the diaphragm to atmospheric pressure from the exterior of the outer housing 11, which enables the diaphragm to contract and expand with respect to the various pressure changes of the cooling liquid 13 within the reservoir 42 during tube operation. Further, and in accordance with embodiments of the present invention, the diaphragm sealing system 200 is configured to prevent leakage of cooling liquid 13 from the outer housing 11 in the event of failure of the diaphragm 150 through rupture, seal compromise, rotationally induced leaks, or other failure.

Note that, though shown connected to an x-ray tube having a particular configuration shown in FIG. 1, the diaphragm sealing system 200 is adaptable such that it can be utilized in connection with various types of x-ray tubes, including single-ended, double-ended, rotary anode, stationary anode tubes, etc. In addition, use of the diaphragm sealing system is not limited to x-ray tubes only. Indeed, other systems utilizing diaphragm-based liquid or liquid cooling systems can also benefit from the-principles of the diaphragm sealing system as discussed herein. Therefore, the discussion to follow should not be interpreted as limiting of the present invention in any way.

Figure 2:
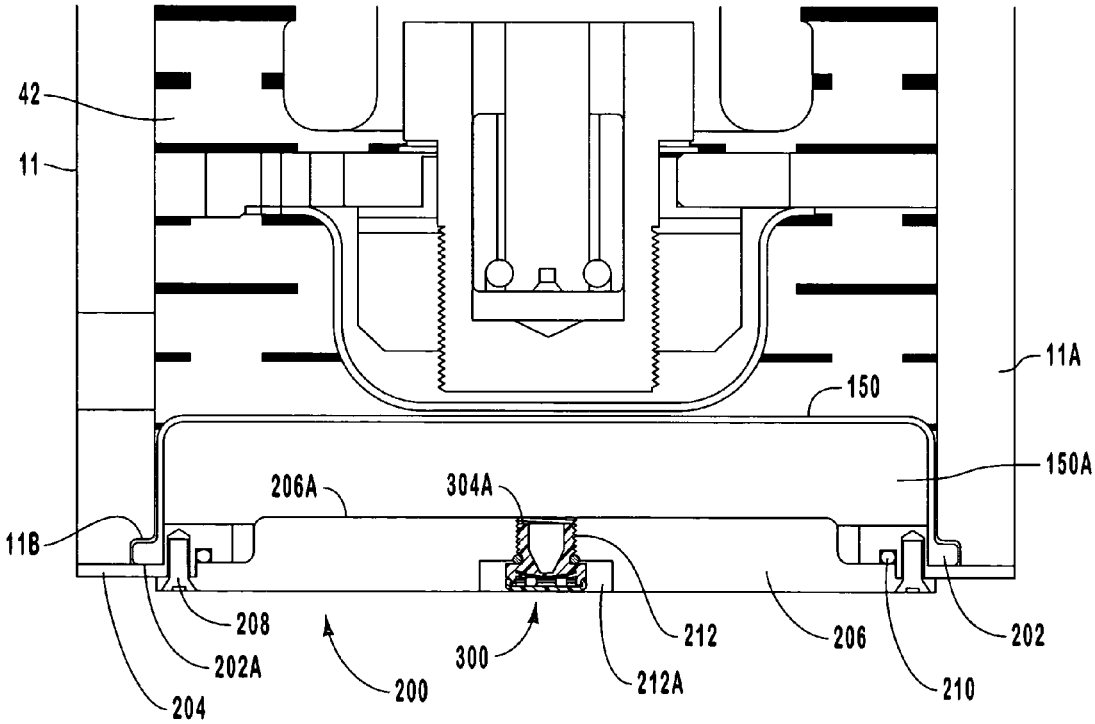
FIG. 2 is a close-up cross sectional view of the diaphragm sealing system of FIG. 1, according to one embodiment.

Reference is now made to FIG. 2, which depicts in greater detail various features of the diaphragm sealing system 200, according to one embodiment. In detail, FIG. 2 shows the diaphragm 150 positioned in the outer housing 11 so as to form a portion of the reservoir 42. The diaphragm 150 includes a sealing edge 202 about the perimeter thereof that forms an annular sealing surface 202A. The sealing surface 202A of the diaphragm 150 cooperates with a sealing surface 11B of the outer housing 11 and a portion of a clamping ring 204 in order to form a fluid-tight seal between the outer housing and the diaphragm, thereby preserving the fluid-tight integrity of the reservoir 42 in order to maintain the cooling liquid therein. Of course, the sealing configuration between the diaphragm 150, the outer housing 11, the clamping ring 204, and other possible components can be modified in accordance with various design changes that are common to x-ray tubes of various types.

The clamping ring 204 is attached to the outer housing 11 so as to assist in forming a fluid-tight seal with respect to the diaphragm 150. In addition, the annular clamping ring 204 provides a component with which a diaphragm cover 206 can be mounted. The diaphragm cover 206 in the present embodiment is disc-shaped and is mounted to the clamping ring 204 via a plurality of screws 208 in order to secure its position. Together with the clamping ring 204 and other components of the diaphragm sealing system 200, the diaphragm cover 206 assists in creating a fluid-tight seal between the diaphragm 150 and the exterior of the outer housing 11. To assist in this sealing, an O-ring 210 is interposed between the clamping ring 204 and the diaphragm cover 206. The diaphragm cover 206 is removable from the clamping ring 204 so as to enable access to the diaphragm 150 for servicing, replacement, etc.

The clamping ring 204 and diaphragm cover 206 can be composed of various materials including plastics, and metallic materials such as aluminum and stainless steel. With regard to the type of material used to form these components, machineable materials are generally preferred. Further, though having circular shapes, the corresponding perimeters of the outer housing 11, the clamping ring 204, the diaphragm cover 206 and the sealing edge 202 of the diaphragm 150 can have other shapes, such as elliptical shapes, in accordance with the needs of a particular application.

A hole 212 is defined through the center of the diaphragm cover 206 to provide a passageway between the exterior of the outer housing and the diaphragm 150. The hole 212 is threaded and includes an extended diameter portion 212A on an outer end thereof. The hole 212, though defined in the center of the diaphragm cover 206 as shown in FIG. 2, can be located in other portions of the diaphragm cover 206, according to the needs of a particular application.

In accordance with one embodiment of the present invention, a membrane seal plug 300 is positioned in the hole 212 of the diaphragm cover 206. The membrane seal plug 300 includes a semi-permeable membrane to be discussed below, that serves as one means for exposing the diaphragm to atmospheric pressure via the passageway and for preventing the passage of the liquid via the passageway provided by the hole 212. As such, the semi-permeable membrane provides protection against cooling liquid leakage from the x-ray tube 10 in the event of diaphragm failure.

Figure 3A:
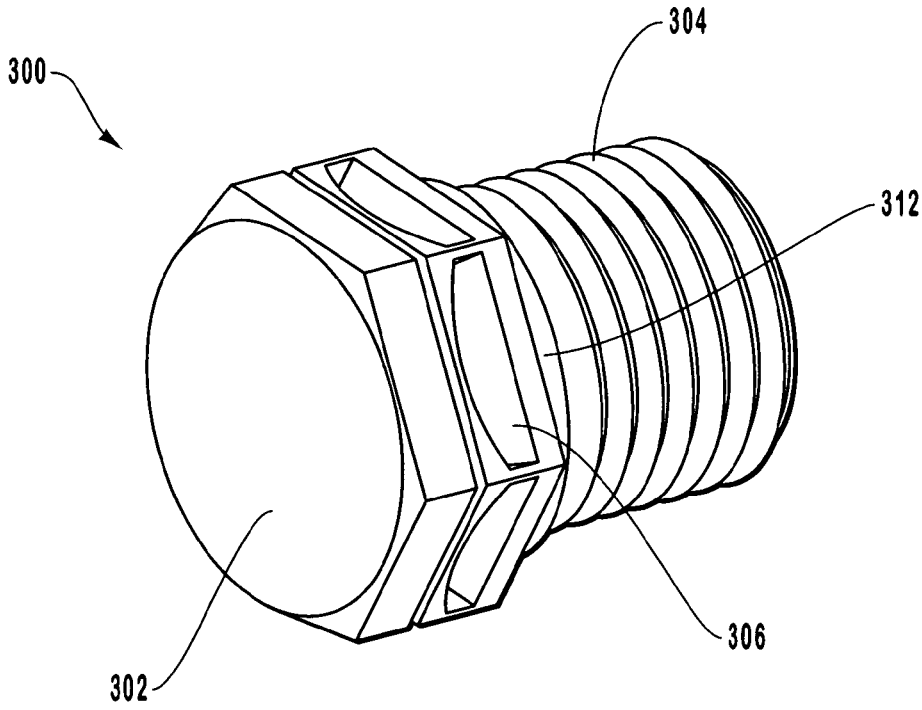
FIG. 3A is a perspective view of a membrane seal plug, according to one embodiment.
Figure 3B:
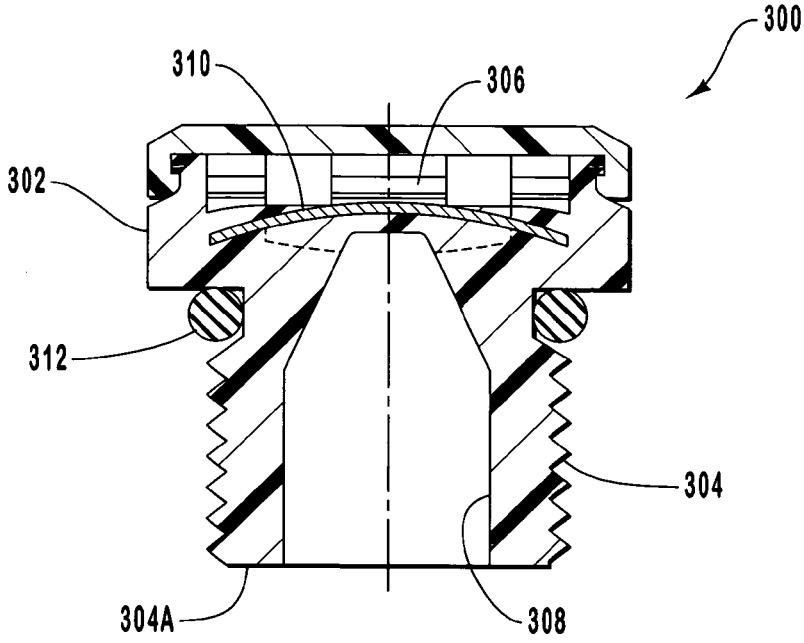
FIG. 3B is a cross sectional view of the membrane seal plug of FIG. 3A.

Reference is now made to FIGS. 3A and 3B, which together depict various features of the membrane seal plug 300. The membrane seal plug 300 shown in FIGS. 3A and 3B is exemplary of similar products manufactured under the name of GORE™ membrane vents by W.L. Gore & Associates, Inc.

As shown, the membrane seal plug 300 of the present embodiment generally includes a head 302 and a stem 304 having a plurality of threads 304 defined thereon for threadingly engaging the membrane seal plug with the correspondingly threaded hole 212 of the diaphragm cover 206 (FIG. 2). In one embodiment, the head 302 and stem 304 are composed of polyamide. The head 302 includes a plurality of vents 306 defined therein that are in communication with a central bore 308 defined through the stem 304. An O-ring 312 is positioned about the membrane seal plug 300 at the interface of the head 302 with the stem 304 in order to create a fluid-tight seal with the hole-212 when the membrane seal plug is threadingly engaged therein. Alternatively, the stem 304 of the membrane seal plug 300 can be smooth and can be adhesively attached to a correspondingly smooth hole 212 in the diaphragm cover 206. Thus, other avenues for attaching the membrane seal plug 300 to the diaphragm cover 206 are also contemplated.

As best shown in FIG. 3B, a semi-permeable membrane 310 is interposed between the plurality of vents 306 and the bore 308 so as to define a semi-permeable cover for the passageway defined by the hole 212. The semi-permeable membrane 310 is positioned such that air, other gases, or vapor must also pass through the membrane in order to travel in either direction through the passageway defined by the hole 212 of the diaphragm cover 206.

In accordance with one embodiment, the semi-permeable membrane 310 is composed of GORE™ membrane, manufactured by W.L. Gore & Associates, Inc. GORE™ membrane is composed of a microporous, expanded PTFE membrane that is naturally hydrophobic and oleophobic to repel water and oil, while still being permissive to the passage of air, other gases, and vapors therethrough. As will be seen, a semi-permeable membrane such as GORE™ membrane enables the diaphragm sealing system 200 (FIG. 2) to operate as described herein. As such, the GORE™ membrane described herein is but one example of a semi-permeable membrane that can be utilized in connection with the diaphragm sealing system 200 described herein. Indeed, other semi-permeable membranes can alternatively be utilized in connection with the principles of the present invention. Necessary properties of such alternative membranes include hydrophobic and oleophobic properties, with the added ability to allow air, other gases, and vapors to pass therethrough.

As shown in FIG. 2, the membrane seal plug 300 is threadingly engaged in the hole 212 of the diaphragm cover 206 such that an end 304A of the stem 304 is positioned near the diaphragm 150, and such that the vents 306 of the head 302 are adjacent the extended diameter portion 212A of the hole. The membrane seal plug 300 is configured such that, when fully seated within the hole 212, the stem end 304A is recessed with respect to the interior an adjacent interior surface 206A of the diaphragm cover 206. Recess of the membrane seal plug 300 in this manner minimizes pressure exertion against the plug by cooling liquid 13 should rupture of the diaphragm 150 occur during tube operation.

The size of the semi-permeable membrane can be varied according to the needs of a particular application. In particular, both the thickness and amount of exposed surface area of the semi-permeable membrane should be sufficient to enable a sufficient amount of air to pass between the exterior of the tube outer housing and the diaphragm so as to enable the diaphragm to respond to changes in cooling liquid pressure quickly enough to avoid the build-up of back pressure. Correspondingly, the size of the membrane seal plug and passageway defined by the hole in the diaphragm cover can be modified so as to provide adequate infrastructure for placement of a semi-permeable membrane having the proper size for adequate air flow to the diaphragm. In other embodiments, multiple semi-permeable membranes and membrane seal plugs can be disposed in the diaphragm sealing system.

As shown in FIG. 2, the membrane seal plug 300 is securely positioned in order to prevent leakage of cooling liquid during tube operation, as described here. Should an unanticipated failure of the diaphragm 150 occur, such as a tear of the diaphragm material, disengagement of the diaphragm sealing edge 202 from the sealing surfaces 202A and/or 11B, etc., cooling liquid 13 will spill into an interior volume 150A of the diaphragm 150. Further progress of cooling liquid 13 from the interior volume 150A to the exterior of the outer housing 11 via the clamping ring 204 or the perimeter of the diaphragm cover 206 is prevented by the sealing of these parts to each other and to the outer housing, together with the inclusion of the O-ring 210 therebetween.

Similarly, escape of cooling liquid 13 via the membrane seal plug 300 is prevented by use of the semi-permeable membrane 310 included therein. As stated above, the membrane 310 is hydrophobic and oleophobic, and is therefore non-transmissive to water and oil-based cooling liquids 13. Thus, any cooling fluid released from the reservoir by failure of the diaphragm 150 is contained within the diaphragm interior volume 150A by the diaphragm sealing system 200, thereby preventing any cooling liquid escape to the outside of the outer housing 11. In this way, complications or hazards arising from the escape of cooling liquid from the x-ray tube due to an unanticipated failure of the diaphragm 150 are prevented. At the same time, it is seen that the semi-permeable membrane 310 of the membrane seal plug 300 operates as desired in allowing atmospheric air pressure to pass through the plug to the diaphragm 150, thereby enabling the diaphragm to maintain the pressure of the cooling liquid 13 at or near 1 atm, or other predetermined pressure.

As shown and described in the embodiments disclosed herein, the semi-permeable membrane 310 serves as one exemplary means for exposing the diaphragm to atmospheric pressure, wherein said means further prevents the passage of the liquid via the passageway defined by the hole 212, thereby providing a semi-permeable barrier between the diaphragm and the ambient atmosphere. As noted above, however, other materials or structure can alternatively serve as a means for performing this function. For example, a semi-permeable membrane composed of a material other than GORE™ membrane can be utilized to prevent escape of cooling liquid from the x-ray tube 10. In addition, structures for retaining a semi-permeable membrane can differ from the structure of the membrane seal plug as shown in FIGS. 2–3B. Thus, the description included herein should not be construed as limiting of the present invention.

The diaphragm sealing system 200 does not hinder initial filling of the reservoir 42 with cooling liquid 13 and proper setting of the diaphragm 150 during tube manufacture or refurbishment. In one embodiment, reservoir filling is accomplished by installing the diaphragm 150, replacing the membrane seal plug 300 in the hole 212 of the diaphragm cover 206 with a temporary sealing device, then filling the interior volume 150A with a placeholder, such as pressurized gas, to maintain the diaphragm 150 in a specified position. The reservoir 42 is then filled with the cooling liquid 13. The temporary sealing device is then removed, and the membrane seal plug 300 is positioned in the diaphragm cover 206. The diaphragm 150 should then be properly positioned for use within the x-ray tube 10.

Figure 4:
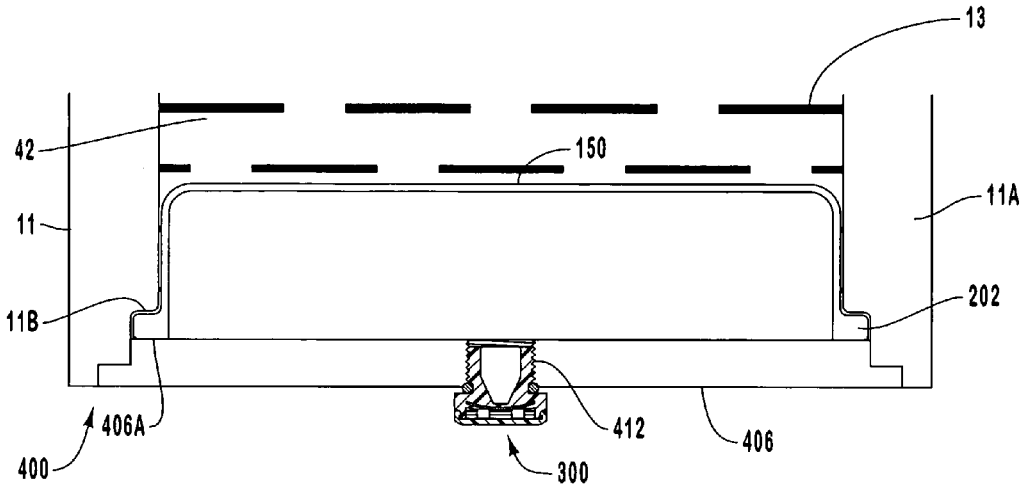
FIG. 4 is a cross sectional view of a diaphragm sealing system according to another embodiment.
Figure 5:
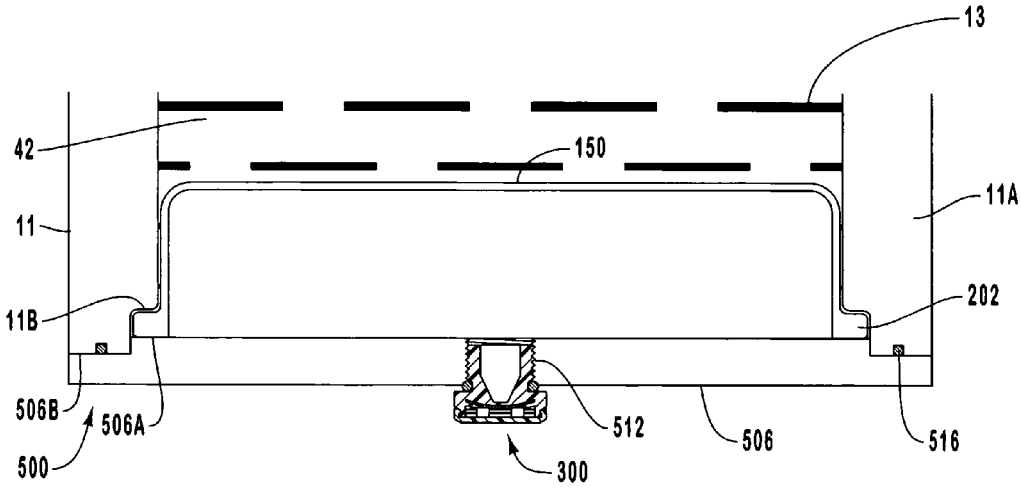
FIG. 5 is a cross sectional view of a diaphragm sealing system according to yet another embodiment.

Reference is now made to FIGS. 4 and 5, which depict various features of diaphragm sealing systems according to other embodiments. In FIG. 4, a diaphragm sealing system 400 is shown as configured for preventing fluid escape from an x-ray tube, such as the x-ray tube 10 shown in FIG. 1, via the diaphragm 150. As such, the system 400 includes a diaphragm cover 406 that defines an annular sealing surface 406A for sealing the diaphragm sealing edge 202 together with sealing surface 11B of the outer housing 11. As before, the diaphragm cover 406 includes a hole 412 in which the membrane seal plug 300 is disposed. In contrast to the previous embodiment, however, no clamping ring is included. Rather, the functionality of the clamping ring is integrated into the diaphragm cover, thereby further simplifying the structure of the diaphragm sealing system 400.

FIG. 5 depicts yet another embodiment of a diaphragm sealing system 500, including a diaphragm cover 506 having an annular sealing surface 506A for sealing the sealing edge 202 of the diaphragm 150 together with the sealing surface 11B of the outer housing 11. As before, the membrane seal plug 300 is positioned in a hole 512 in the diaphragm cover 506. Similar to the embodiment shown in FIG. 4, the sealing system 500 does not include a clamping ring. In contrast to the embodiment of FIG. 4, however, an O-ring 516 is interposed between the end of the outer housing 11 and a corresponding, annular mating surface 506B of the diaphragm cover 506. The O-ring 516 serves as a fail-safe barrier for preventing cooling liquid leakage past the interface of the outer housing 11 and the diaphragm cover mating surface 506B, further fortifying the diaphragm sealing system 500 against cooling liquid leakage should rupture or failure of the diaphragm 150 occur.

Figure 6:
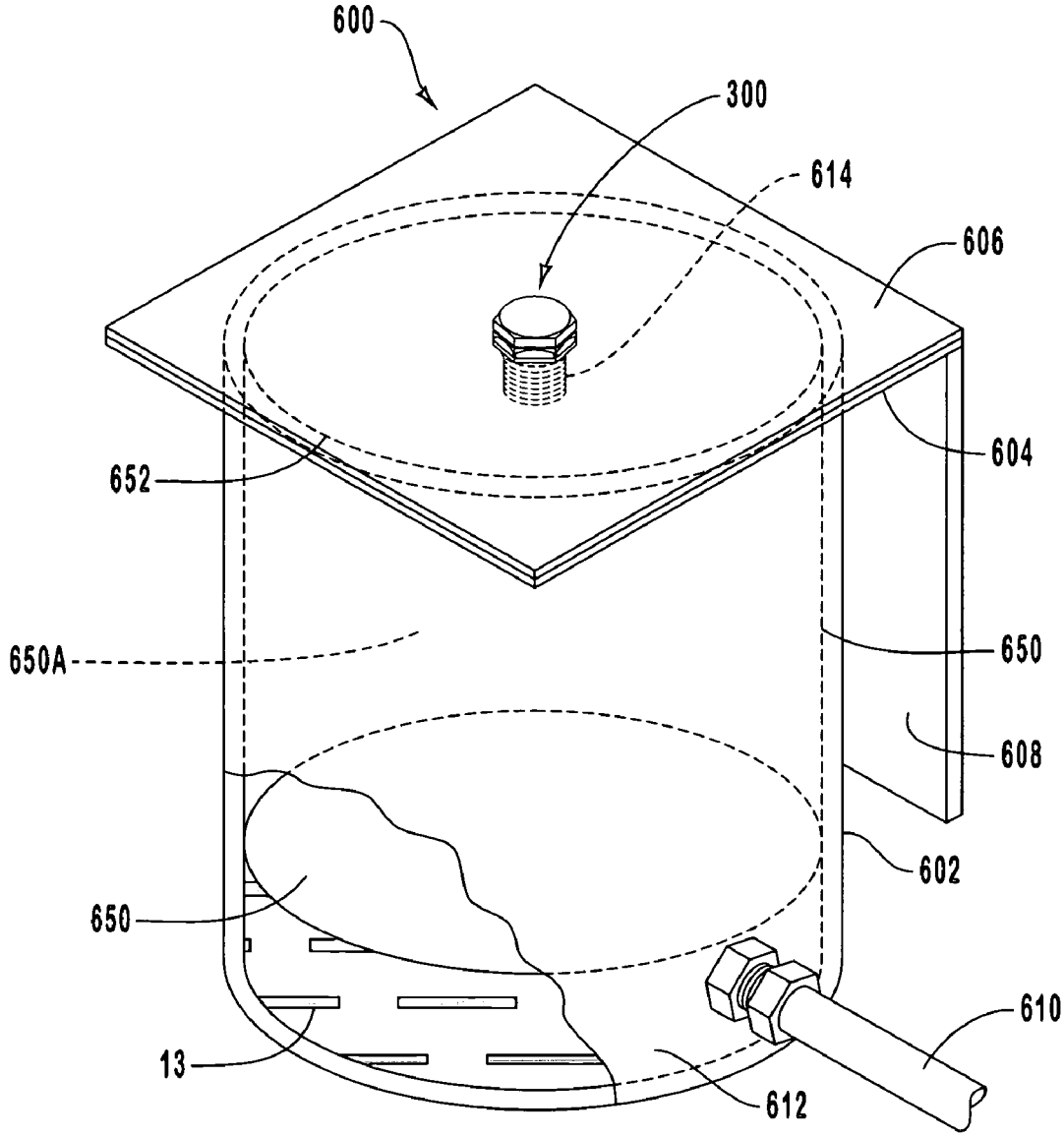
FIG. 6 shows a perspective/cutaway view of an expansion chamber incorporating a membrane seal plug as part of a diaphragm sealing system according to one embodiment.

Reference is now made to FIG. 6, which depicts yet another embodiment of a diaphragm sealing system of the present invention. In detail, FIG. 6 shows an expansion chamber generally designated at 600 for use in a heat exchanger, such as the heat exchanger 46 shown in FIG. 1, in removing heat from cooling liquid 13 of an x-ray tube, such as the x-ray tube 10 shown in FIG. 1. Alternatively, the expansion chamber 600 can be configured as a stand alone system and can be mounted, for instance, to the exterior of the outer housing of the x-ray tube or inside an apparatus in which the x-ray tube is disposed. As such, though not explicitly described herein, other components in addition to what is shown in FIG. 6 can be included in connection with the expansion chamber 600.

As illustrated, the expansion chamber 600 includes a housing 602 having a lip 604 that mates with an end plate 606. In addition, a bracket 608 is included to enable mounting of the expansion chamber 600 to an appropriate surface. A fluid line 610 is shown attached to the housing 602 to enable cooling liquid 13 to be pumped to and from a reservoir 612 defined by the housing. A diaphragm 650 is included in the housing 602 and is attached thereto via a sealing edge 652 that engages with the lip 604 and end plate 606 such that it is secured with respect to the housing. So attached, the diaphragm 650 contributes in defining the reservoir 612 within the housing 602. A hole 614 defined in the end plate 606 receives in a threaded or other suitable form of engagement the membrane seal plug 300 as disclosed in earlier embodiments. So positioned, the membrane seal plug 300 defines a diaphragm sealing system, according to the illustrated embodiment. The membrane seal plug 300 is in communication with an interior volume 650A of the diaphragm 650. In this configuration, any rupture, leakage, or failure of the diaphragm 650 that may introduce cooling liquid 13 into the interior volume 650A will result in the membrane seal plug 300 preventing escape of such cooling liquid from the expansion chamber 600, preserving the integrity thereof and preventing complications and hazards associated with cooling liquid escape, as described above. At the same time, by virtue of the semi-permeable membrane located therein, the membrane seal plug 300 enables the exposure of the diaphragm 650 to atmospheric air pressure, desirably enabling a consistent cooling liquid pressure to be maintained within the housing 602. Though not explicitly shown, a backup O-ring seal can be included between the lip 604 and the end plate 606 to further preserve the fluid-tight integrity of the housing 602.

Figure 7:
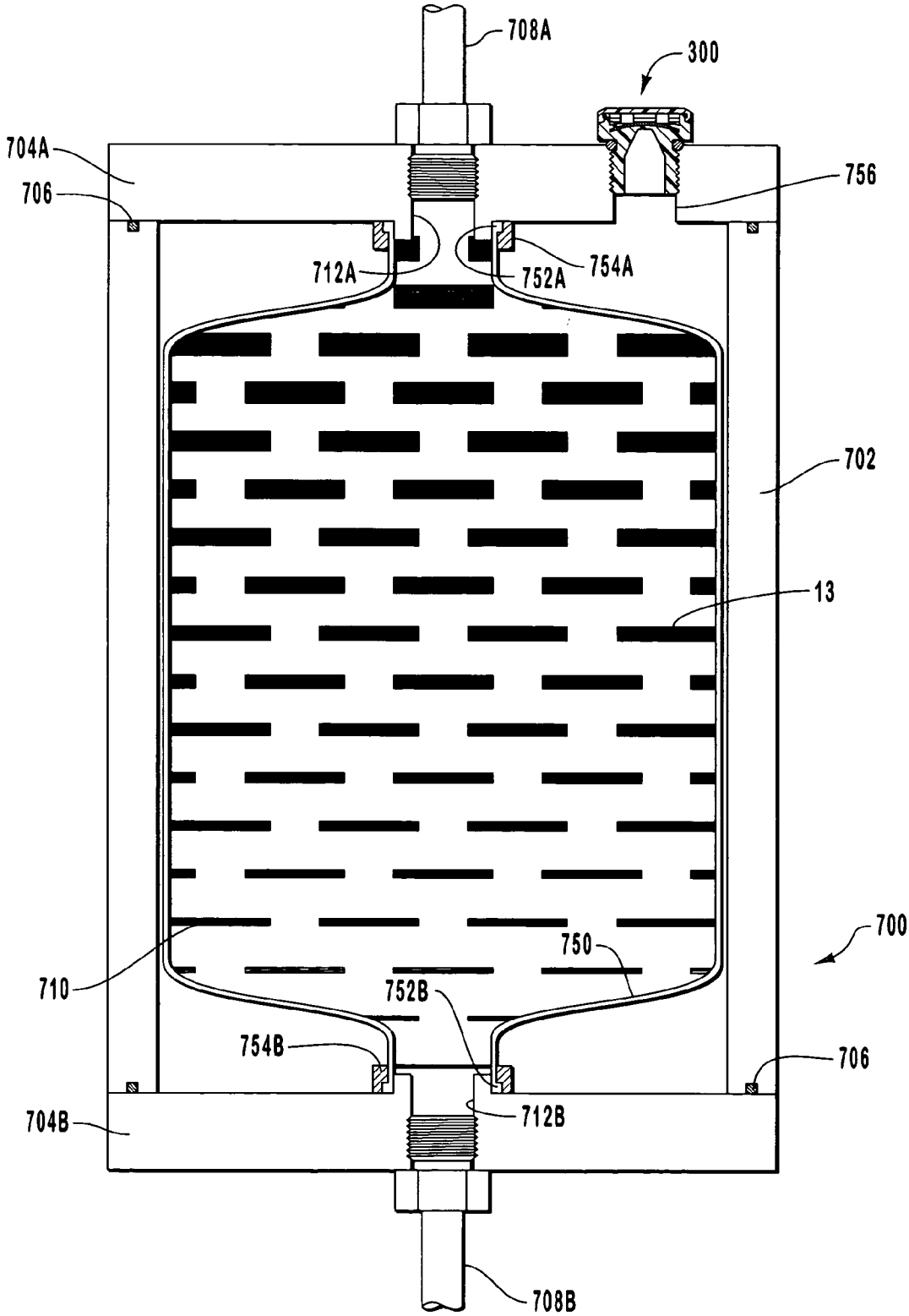
FIG. 7 is a cross sectional view of an in-line cooling liquid reservoir incorporating a diaphragm sealing system having a membrane seal plug, according to yet another embodiment of the present invention.

Reference is now made to FIG. 7. As demonstrated by the embodiment of FIG. 6, the membrane seal plug and associated semi-permeable membrane positioned therein, can function as a diaphragm sealing system in a variety of possible environments. FIG. 7 shows yet another example of this, wherein an in-line chamber is shown and generally designated at 700. The chamber 700 is included as an in-line system along a cooling liquid path for use by a device, such as the x-ray tube 10 shown in FIG. 1. As such, the in-line chamber 700 can connect with fluid transport lines, such as the first or second fluid lines 44 and 48 shown in FIG. 1, in an in-line arrangement. Such a configuration may be desirable when space does not permit placement of a diaphragm within the x-ray tube itself, or when access to the diaphragm is facilitated by placing it apart from the x-ray tube or other apparatus.

In detail, the in-line chamber 700 includes a housing 702, having attached end caps 704A and 704B. O-rings 706 are interposed between either end of the housing 702 and the respective end caps 704A and 704B to form a fluid-tight arrangement therebetween. Fluid lines 708A and 708B respectively interface with fluid inlet/outlets 712A and 712B, respectively defined in the end caps 704A and 704B, in order to provide a liquid input and outlet to the housing 702.

A diaphragm 750 is included within the housing 702 and forms a reservoir 710 in which cooling liquid 13 is contained. The diaphragm 750 is double-ended such that it forms sealing edges 752A and 752B on its respective ends. The sealing edges 752A and 752B seat within respective clamping rings 754A and 754B in order to form a fluid-tight seal between the diaphragm 750 and the fluid inlet/outlets 712A and 712B corresponding to fluid lines 708A and 708B, respectively.

As shown in FIG. 7, a hole 756 is defined in one of the end caps 704A/704B for receiving therein the membrane seal plug 300. Alternatively, the hole 756 could be defined in other portions of the housing 702, if desired, assuming it does not interfere with operation of the diaphragm 750. Placement of the membrane seal plug 300 in connection with the aforementioned components enables the diaphragm 750 to be exposed to atmospheric pressure via the semi-permeable membrane included within the membrane seal plug, thereby enabling the diaphragm to expand and contract in response to volume and pressure changes of the cooling liquid 13, as explained earlier. In addition, the fluid-tight nature of the in-line chamber 700, together with the hydrophobic and oleophobic nature of the semi-permeable membrane seal included within the membrane seal plug 300, prevents leakage of cooling liquid 13 in the event of rupture or failure of the diaphragm 750. Thus, any leakage of cooling liquid beyond the reservoir 710 defined by the diaphragm 750 is contained within the housing 702, thereby precluding complications and/or hazards associated with escape of the liquid into the surrounding environment.

The system shown in FIG. 7 is exemplary of sealing systems associated with diaphragms that are incorporated into an in-line liquid system. Thus, the principles taught in this discussion can be extended to configurations that vary from the embodiments shown here. For instance, an in-line system can include a single-ended diaphragm instead of the double-ended diaphragm shown in FIG. 7. Or, the housing can have a shape that varies from that shown here. Thus, these and other modifications are within the spirit of the present invention as disclosed in this and other embodiments herein.

More generally, one or more semi-permeable membranes can be used in connection with multiple diaphragms in a particular apparatus. Further, the relatively small size of the membrane seal plug enables it to be positioned in various locations with respect to the diaphragm, thereby increasing system flexibility.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. A diaphragm sealing system comprising:

a diaphragm that defines at least a portion of a reservoir containing a liquid, and the reservoir being partially defined by an outer housing of an x-ray tube;

a passageway defined between the diaphragm and a region of atmospheric pressure; and means for exposing the diaphragm to atmospheric pressure via the passageway, wherein said means further prevents the passage of the liquid via the passageway.

2. A diaphragm sealing system as defined in claim 1, wherein the liquid is a cooling liquid, and wherein the means for exposing prevents the escape of the cooling liquid from the x-ray tube upon the failure or rupture of the diaphragm.

3. A diaphragm sealing system as defined in claim 1, wherein the means for exposing possesses hydrophobic and oleophobic properties.

4. A diaphragm sealing system as defined in claim 1, wherein the means for exposing allows air, gases, and vapors to be transmitted via the passageway.

5. A diaphragm sealing system as defined in claim 1, wherein the means for exposing comprises a semi-permeable membrane positioned in the passageway.

6. A diaphragm sealing system as defined in claim 5, wherein the semi-permeable membrane is included within a membrane seal plug that is received within a hole defined in a structure in proximity to the diaphragm, the hole defining the passageway.

7. An x-ray tube, comprising:

an evacuated enclosure containing an electron source and an anode positioned to receive electrons produced by the electron source, the evacuated enclosure being in liquid communication with a cooling liquid;

a diaphragm contained within a housing, the diaphragm being in liquid communication with the cooling liquid; and a semi-permeable membrane that is interposed between the diaphragm and an exterior of the housing such that the diaphragm is exposed to atmospheric air pressure.

8. An x-ray tube as defined in claim 7, wherein the semi-permeable membrane is transmissive to air, other gases, and vapors, and is non-transmissive to the cooling liquid such that cooling liquid leakage from the diaphragm is prevented from passing through the semi-permeable membrane.

9. An x-ray tube as defined in claim 7, wherein the semi-permeable membrane is positioned in a passageway defined proximate the diaphragm, and wherein the passageway is the sole source of atmospheric pressure to the diaphragm.

10. An x-ray tube as defined in claim 7, wherein the cooling liquid is a dielectric oil.

11. An x-ray tube as defined in claim 7, wherein the housing is an outer housing that also contains the evacuated enclosure.

12. An x-ray tube as defined in claim 11, wherein the semi-permeable membrane is included within a hole defined in a cover plate that at least indirectly attaches to the outer housing.

13. An x-ray tube as defined in claim 12, wherein an O-ring is interposed between the cover plate and the outer housing.

14. An x-ray tube as defined in claim 7, wherein the housing is an expansion chamber having a lip and an end plate that cooperate to secure the diaphragm in place, and wherein the semi-permeable membrane is located in a passageway defined in the end plate.

15. An x-ray tube as defined in claim 14, wherein the expansion chamber is included in a heat exchanger for cooling the cooling liquid.

16. An x-ray tube as defined in claim 7, wherein the housing is an in-line housing having a fluid inlet and a fluid outlet.

17. An x-ray tube, comprising:

an evacuated enclosure containing an electron source and an anode positioned to receive electrons produced by the electron source;

an outer housing partially defining a reservoir that contains a cooling liquid for cooling the evacuated enclosure, the evacuated enclosure being positioned in the reservoir in liquid communication with the cooling liquid;

a diaphragm attached to the outer housing and in liquid communication with the cooling liquid such that the diaphragm defines a portion of the reservoir; and a diaphragm sealing system including:

a cover attached to an end of the housing proximate the diaphragm; and a semi-permeable membrane included with the cover to expose the diaphragm to atmospheric pressure.

18. An x-ray tube as defined in claim 17, wherein the semi-permeable membrane prevents the passage of cooling liquid past the diaphragm sealing system upon rupture or failure of the diaphragm.

19. An x-ray tube as defined in claim 18, wherein the semi-permeable membrane is transmissive to air and vapors, and is non-transmissive to the cooling liquid.

20. An x-ray tube as defined in claim 19, wherein the semi-permeable membrane is included in a membrane seal plug that is positioned in a hole forming a passageway, the hole being defined in the cover.

21. An x-ray tube as defined in claim 20, wherein the hole is the sole source of atmospheric pressure to the diaphragm.

22. An x-ray tube as defined in claim 21, wherein the semi-permeable membrane is GORE™ membrane.

23. An x-ray tube as defined in claim 22, wherein a clamping ring is interposed between the end of the housing and the cover.

24. An x-ray tube as defined in claim 23, wherein an extended diameter portion is included on an exterior end of the hole to provide clearance for a plurality of vents located on the membrane seal plug.

25. An x-ray tube as defined in claim 24, wherein the membrane seal plug is threadably engaged with the hole in the cover.

26. An x-ray tube as defined in claim 25, wherein an interior end of the membrane seal plug is recessed with respect to an inner surface of the cover.

27. An x-ray tube as defined in claim 26, wherein the diaphragm is configured to maintain the cooling liquid at atmospheric pressure.

28. An x-ray tube, comprising:

an evacuated enclosure containing an electron source and an anode, the evacuated enclosure being disposed in a housing that is configured to hold a volume of a cooling liquid;

an in-line chamber having fluid inlet and outlet connections that are in fluid communication with the housing;

a double-ended diaphragm disposed within the in-line chamber, the double-ended diaphragm defining an inlet that is in fluid communication with the inlet of the in-line chamber, and the double-ended diaphragm further defining an outlet that is in communication with the outlet of the in-line chamber; and a membrane having a first side exposed to the interior of the in-line chamber and a second side exposed to the atmosphere, the membrane being substantially transmissive with respect to atmospheric air and substantially non-transmissive with respect to the cooling liquid.

* * * * *